US008212189B2

(12) United States Patent
Imura

(10) Patent No.: US 8,212,189 B2
(45) Date of Patent: Jul. 3, 2012

(54) STOVETOP INTERFACE, SYSTEM AND METHODS OF TEMPERATURE CONTROL OF COOKWARE, AND METHODS OF COOKING USING NUMERICAL TEMPERATURE CONTROL

(76) Inventor: Mamoru Imura, Overland Park, KS (US)

( * ) Notice: Subject to any disclaimer, the term of this patent is extended or adjusted under 35 U.S.C. 154(b) by 1504 days.

(21) Appl. No.: 11/561,415

(22) Filed: Nov. 19, 2006

(65) Prior Publication Data

US 2007/0145034 A1 Jun. 28, 2007

Related U.S. Application Data

(63) Continuation-in-part of application No. 10/833,356, filed on Apr. 28, 2004, now Pat. No. 7,157,675, and a continuation-in-part of application No. 11/148,802, filed on Jun. 9, 2005.

(60) Provisional application No. 60/738,259, filed on Nov. 18, 2005.

(51) Int. Cl.
*H05B 1/02* (2006.01)

(52) U.S. Cl. ... 219/494; 219/497; 219/506; 219/448.12; 219/412; 374/102

(58) Field of Classification Search ..... 219/490, 219/491, 497, 501, 506, 443.1, 448.12; 374/101, 374/102

See application file for complete search history.

(56) References Cited

U.S. PATENT DOCUMENTS

| | | | | |
|---|---|---|---|---|
| 3,742,178 | A | 6/1973 | Harnden, Jr. | |
| 3,742,179 | A | 6/1973 | Harnden, Jr. | |
| 4,234,784 | A * | 11/1980 | Totterdell | 219/506 |
| 4,316,256 | A * | 2/1982 | Hendricks et al. | 700/278 |
| 5,441,344 | A | 8/1995 | Cook, III | |
| 5,951,900 | A | 9/1999 | Smrke | |
| 5,954,984 | A | 9/1999 | Ablah et al. | |
| 6,206,564 | B1 | 3/2001 | Adamczewski | |
| 6,232,585 | B1 | 5/2001 | Clothier et al. | |
| 6,274,856 | B1 | 8/2001 | Clothier et al. | |
| 6,316,753 | B2 | 11/2001 | Clothier et al. | |
| 6,320,169 | B1 | 11/2001 | Clothier | |
| 6,444,961 | B2 | 9/2002 | Clothier et al. | |
| 6,504,135 | B2 | 1/2003 | Clothier et al. | |
| 6,512,211 | B1 | 1/2003 | Lockhart et al. | |
| 6,563,087 | B1 | 5/2003 | Yokoyama et al. | |

(Continued)

FOREIGN PATENT DOCUMENTS

FR 2714960 1/1994

OTHER PUBLICATIONS

EPO Office Action, mailed Apr. 14, 2011 in related Regional Stage filing of PCT/2006/061121.

*Primary Examiner* — Mark Paschall
(74) *Attorney, Agent, or Firm* — Bryan P. Stanley; Marcellus A. Chase; Kutak Rock LLP

(57) ABSTRACT

A temperature control interface for a stove top is provided. The temperature control interface includes a numerical temperature setting to which a temperature of an object heated on the stovetop will be regulated. A method of cooking on a stovetop is provided in which a recipe includes a numerical temperature to which a cookware object should be regulated during cooking.

18 Claims, 1 Drawing Sheet

U.S. PATENT DOCUMENTS 6,657,170 B2 12/2003 Clothier
6,664,520 B2 12/2003 Clothier
6,822,204 B2 11/2004 Clothier
6,953,919 B2 10/2005 Clothier
2002/0113061 A1* 8/2002 Hammelsbacher et al. .. 219/506
2003/0094448 A1* 5/2003 Shukla et al. ..... 219/487
2004/0016348 A1 1/2004 Sharpe
2006/0108852 A1* 5/2006 Boucher ..... 297/423.41

* cited by examiner

STOVETOP INTERFACE, SYSTEM AND METHODS OF TEMPERATURE CONTROL OF COOKWARE, AND METHODS OF COOKING USING NUMERICAL TEMPERATURE CONTROL

This application claims priority pursuant to 35 U.S.C. 119 (e) to U.S. Provisional Patent Application Ser. No. 60/738,259, filed Nov. 18, 2005, the entire disclosure of which is incorporated herein by reference. This application is a continuation-in-part of U.S. application Ser. No. 10/833,356 filed Apr. 28, 2004 now U.S. Pat. No. 7,157,675 and U.S. applications Ser. No. 11/148,802, filed Jun. 9, 2005, the disclosures of which are incorporated herein by reference in their entireties.

FIELD OF THE INVENTION

The present invention is broadly concerned with cookware and cooking appliances. More particularly, the invention is concerned with: temperature regulated cookware and servingware items, such as pots, pans, buffet serving pans, serving dishes, platters, and the like; a temperature control interface for manual control of a stovetop; and methods of cooking on a stovetop using a numerical control interface.

BACKGROUND OF THE INVENTION

Cooking is often referred to as an art, not only because of the combination of ingredients that go into a particular recipe, but also due to the skill necessary for proper application and infusion of varying levels of heat over a given period of time throughout the different phases of the food preparation process. Traditional cookware appliances, such as ovens (microwave ovens being an exception), grills, heat lamps and stoves, all utilize the thermodynamic process of conduction to transfer heat from the outer surface of the food item to its interior. This is generally true regardless of the type of heat source used to heat the surface of the food, be it a radiation heat source (i.e. a heat lamp), conduction heat source (i.e. a stovetop), or a convection heat source (i.e. a convection oven or a food dehydrator).

The use of thermometers or other temperature sensors to monitor and control the cooking process is well known. A common thermometer used to monitor and control the cooking process is a probe-type or contact thermometer which is inserted directly into the food item to obtain a temperature of the interior of the food item. Such thermometers are undesirable for use with cookware/servingware objects that have a lid as the use of a probe-type thermometer requires removal of the lid each time a temperature reading is taken. A number of cookware-associated non-contact thermometers have been developed that are attached to, or incorporated into, cookware objects such as pots and pans. For example, my invention disclosed in U.S. patent application Ser. No. 10/833,356, which is incorporated herein by reference in its entirety, provides a means of obtaining consistent and accurate measurement and control of the temperature of a cookware object, such as a pot or pan, by embedding a temperature sensor within a heatable portion of an object, such as within a tunnel through the base of the pot or pan. The temperature sensor is connected to an RFID tag located apart from the heatable portion of the pot or pan. The RFID tag acts as a transmitter (and sometimes as receiver) to communicate with a reader/writer located in a cook-top for heating the object, providing temperature information and other information regarding the object (such as heating characteristics) to the cook-top. The temperature information and the heating information are used by the cook-top to control the temperature of the object.

My prior invention in which the temperature sensor is embedded within a tunnel in the base, as disclosed in U.S. patent application Ser. No. 10/833,356, and in U.S. application Ser. No. 11/148,802 filed Jun. 9, 2005 (the disclosure of which is incorporated herein in its entirety), provides a highly effective way of regulating temperature during cooking. This allows a selected cooking temperature to be maintained while cooking on a stovetop. The cooking temperature can be programmed into the stovetop in the manner described in U.S. Pat. No. 6,953,919 (the entire disclosure of which is incorporated herein by reference), or the temperature can be selected manually (as is also disclosed in U.S. Pat. No. 6,953,919). Notwithstanding, although a desired cooking temperature may be manually selected by the cook, stovetop control interfaces of the prior art do not provide the cook any indication of the actual temperature that is being selected. For example, referring to FIG. 1, a dial-type stovetop control interface of the prior art is shown. Similar control interfaces are common on all types of stovetops, including induction, gas, electric, radiant, halogen, etc. The control interface shown in FIG. 1 allows the cook to select a temperature based upon a quantitative descriptor such as "simmer", "low", "medium", or "high". Turning the knob to "medium" may always heat the pan to 120 degrees C (and this may in fact be preprogrammed into the stovetop, such as in the manner disclosed in U.S. Pat. No. 6,953,919), but unless the cook has measured the temperature with his/her own thermometer, he/she has no way of knowing the exact temperature. This is because the quantitative descriptors (i.e. "simmer", "low", "medium", or "high") are arbitrarily matched to specific temperatures by the stovetop manufactures. Thus, "med" on one stovetop may be 120C, while on another stovetop, it will be 150C. Also, these arbitrary quantitative temperature descriptors may vary depending upon the type of stovetop, i.e. induction, gas, electric, radiant, etc., due to the fact that the maximum heat that may be generated by each source will vary (e.g. gas 1300C, radiant 800C). Therefore, it would be beneficial to provide a stovetop temperature control interface that allows the cook to know the exact temperature that is manually being selected.

Furthermore, stovetop recipes traditionally utilize the same arbitrary quantitative descriptors (i.e. "simmer", "low", "medium", or "high") as are used on stovetops. Thus, due to the large degree of variance between different brands of stovetops and sources of heat (i.e. induction, gas, electric, etc.), as well as variations due to different altitudes, the recipes must be altered (or the cooks must know to vary the temperature) to avoid the dishes being improperly cooked. Therefore, it would be beneficial to provide a method of stovetop cooking that provides more consistent results regardless of the stovetop being used and the altitude at which a dish is prepared.

SUMMARY OF THE INVENTION

An object of the instant invention is to provide temperature regulated items (or objects). Another object of the instant invention is to provide a stovetop temperature control interface that allows the cook to know the exact temperature that is manually being selected. Yet another object of the instant invention is to provide a method of stovetop cooking that provides more consistent results regardless of the stovetop being used and the altitude at which a dish is prepared.

The above described objects are achieved using a temperature regulated object such as is described in U.S. patent application Ser. No. 10/833,356, and/or in and U.S. application Ser. No. 11/148,802 (including a heatable body, a temperature sensor, and an RFID tag (or other suitable transmitter/receiver)), and a stovetop including an RFID reader/writer (or other suitable transmitter/receiver). The stovetop further includes a temperature control interface (as is shown in FIG.

2) that allows the user to select a specific numerical temperature to which the temperature of the heatable object will be regulated.

The heatable objects of preferred embodiments of the instant invention are constructed and operate in a manner similar to the cookware/servingware objects disclosed in U.S. patent application Ser. No. 10/833,356, and/or in and U.S. application Ser. No. 11/148,802, utilizing the same or similar components and materials, including the materials for the body of the object, the handle materials, the RFID tag, RFID reader/writer and the RTD sensor. Nevertheless, it will be appreciated that alternative manners of construction and operation may be developed without departing from the spirit and scope of the instant invention, and modifications to certain components may be made to accommodate the location of the temperature sensor in the instant invention.

Since the temperature control interface shown in FIG. 2 informs the cook of the exact numerical temperature which is being selected, stovetop recipes may be utilized based upon numerical temperature rather than the quantitative descriptors (i.e. "simmer", "low", "medium", or "high"). By providing recipes based upon specific numerical temperature values, more consistent results may be obtained regardless of the brand or power source (i.e. electric, gas, induction, etc.) for the stovetop, and regardless of the altitude. The cook simply reads the numerical temperature from the recipe and manually sets the temperature to be regulated using the control knob shown in FIG. 2.

It will be appreciated that although shown as a control knob in FIG. 2, the temperature control interface of the instant invention may comprise a digital control interface, or any other interface that allows a user to manually select a temperature and which displays the temperature being selected, whether now known or hereafter discovered. The control and temperature display may be a single unit as shown in FIG. 2, or the temperature display may be separate from the control that allows the temperature to be selected. Furthermore, it will be appreciated that the control interface of the instant invention, and the method of cooking utilizing the control interface, may be utilized with temperature controllable cookware that includes temperature sensors that communicate with the stovetop (as described in U.S. patent application Ser. No. 10/833,356, and/or in and U.S. application Ser. No. 11/148,802), or utilizing one of numerous alternative methods now known or hereafter discovered. For example, temperature sensors may monitor the temperature of the stovetop itself, sensors within the stovetop may monitor the temperature of the cookware (i.e. infrared sensors), or cooking temperature can be controlled based upon the amount of power being provided by the stovetop.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
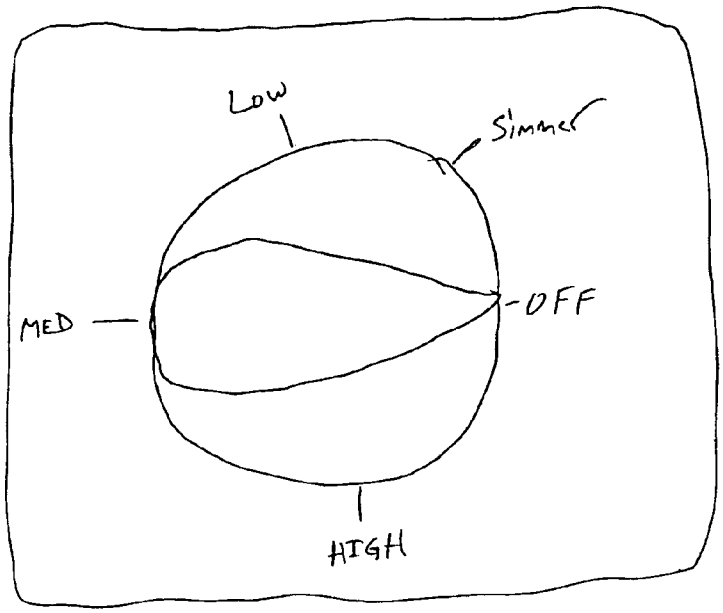
Fig 1 (Prior Art)
FIG. 1 is a top view of a stovetop temperature control interface of the prior art.
Figure 2:
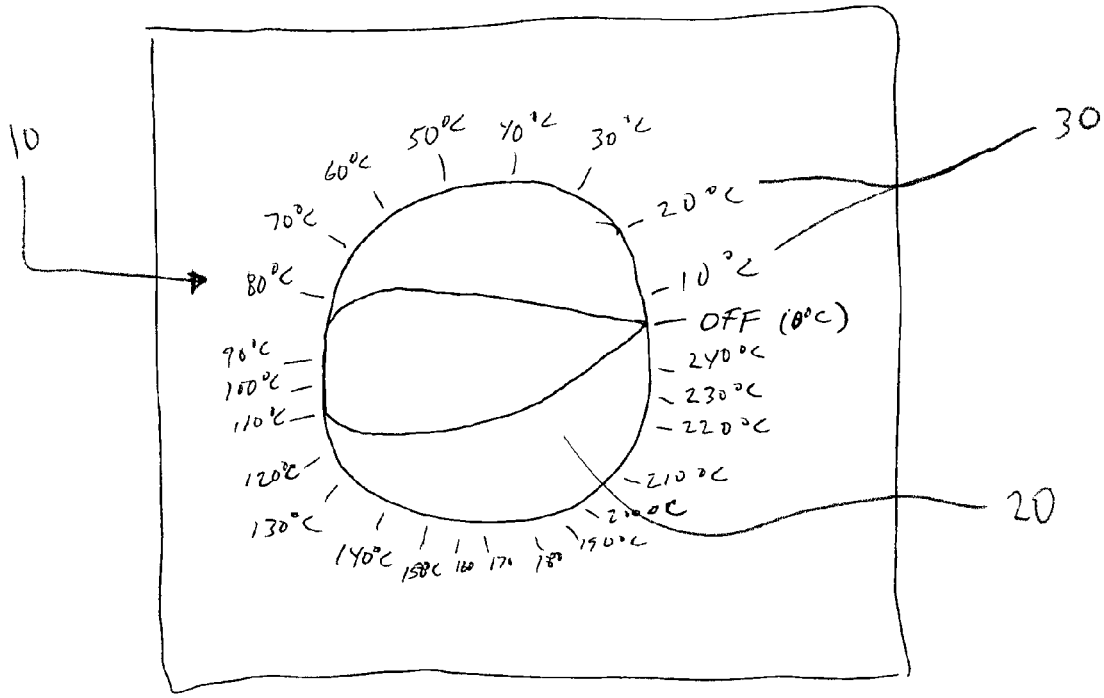
FIG. 2 is a top view of a stovetop temperature control interface of the instant invention.

Referring to FIG. 2 a stovetop temperature control interface, 10, of the instant invention is shown. Interface 10 includes control knob 20 (temperature selector) and incremental numerical temperature settings 30. In operation control knob 20 is adjusted by an operator (i.e. a cook) by turning the knob to the temperature setting 30 corresponding to a numerical temperature that is desired to be used for cooking. In the preferred embodiment the cooking temperature is a numerical temperature that is set forth in a recipe. For example, a recipe may specify that a food item should be heated for 20 minutes at 100 degrees Celsius. In such case, control knob 20 is turned to the temperature setting (30) reading 100 degrees Celsius. The temperature of a cookware object located on the stovetop may then be controlled in a manner similar to that described in U.S. Pat. No. 6,953,919 such that the temperature of the object is maintained at 100 degrees Celsius.

A cookware object, such as a pot or pan, constructed in the manner disclosed in U.S. patent application Ser. Nos. 10/833,356 and 11/148,802 is placed on a hob of the stovetop that is controlled by control knob 20. The cookware object includes an RFID tag that is connected to a temperature sensor embedded in a tunnel in the heatable portion of the object. The temperature sensor measures the temperature of the object as it is being heated by the stovetop. The RFID tag communicates via RF signals with an RFID reader/writer located in the stovetop. The RFID reader/writer is connected to a processor that is also connected to interface 10 and to the power source for the hop of the stovetop. The processor receives temperature information measured by the temperature sensor of the object via the RF transmission from the RFID tag to the RFID reader/writer. The processor then utilizes that information to control the power source for the hop to regulate the temperature of the cookware object to the temperature set by control knob 20. For example, if the temperature reading from the temperature sensor is lower than the temperature set by control knob 20 the processor will increase power (or maintain the current power if it is providing appropriate heating energy) to the power source for the hob so that the object is heated. If the temperature reading by the temperature sensor is at or above the temperature set by control knob 20 the processor will decrease power. If the heating source is an induction heating source, the increase or decrease in power is an increase or decrease (or termination of) in electric current through an induction coil. If the heating source is gas, the increase or decrease in power will be by controlling a gas valve to increase or decrease (or terminate) the flow of gas to the cooking hob. It will be appreciated, that any other heating source now known or hereinafter developed (including but not limited to electric, gas, or induction) may be used in connection with the control interface and methods of the instant invention.

Although incremental temperature settings 30 are shown in FIG. 2 in increments of ten degrees Celsius, it will be appreciated that other increments (such as five degrees, one degree, fractions of a degree, etc.) may be utilized without departing from the spirit and scope of the instant invention. Furthermore, it will be appreciated that other units of measurement (such as degrees Fahrenheit) may be utilized without departing from the spirit and scope of the instant invention.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A temperature control interface for a stovetop comprising:

a temperature control selector for manually selecting a temperature;

a numerical temperature setting displayed on a temperature control interface.

2. The temperature control interface as claimed in claim 1 wherein said temperature control selector is a control knob.

3. The temperature control interface as claim in claim 1 wherein said temperature control selector is a digital controller.

4. The temperature control interface as claimed in claim 1 wherein said temperature control selector and said numerical temperature setting display are a single unit.

5. The temperature control interface as claimed in claim 1 wherein said temperature control selector and said numerical temperature setting display are separable.

6. The temperature control interface as claimed in claim 1 further comprising a processor to control the power of a stovetop hob to regulate the temperature of said stovetop hob.

7. The temperature control interface as claimed in claim 1 further comprising:

a temperature sensor to measure the temperature of one of a stovetop hob or a cookware object placed on said stovetop hob; and a processor to control the power of said stovetop hob;

wherein if the temperature measured by said temperature sensor is lower than the temperature set by said temperature control selector, the power to said stovetop hob is either increased or maintained; and if the temperature measured by said temperature sensor is higher than or equal to the temperature set by said temperature control selector, the power to said stovetop hob is decreased.

8. A method of cooking on a stovetop comprising the steps of:

measuring the temperature of a cookware object that is placed on a hob of the stovetop;

manually setting a numerical temperature and displaying said set temperature on a temperature control interface to which said set temperature of said cookware object is to be regulated; and controlling the power of said hob to regulate said temperature of said cookware object.

9. The method of claim 8, wherein said temperature control interface comprises the temperature control interface as claimed in claim 1.

10. The method of claim 8, further comprising manually setting said numerical temperature setting on said temperature control interface to a specific numerical temperature value acquired from a recipe.

11. The method of claim 8, wherein said cookware object comprises a temperature controllable cookware object that includes a temperature sensor that communicates with said temperature control interface.

12. The method of claim 8, wherein a temperature sensor within said stovetop monitors the temperature of the cookware.

13. The method of claim 12, wherein said temperature sensor within the stovetop comprises an infrared temperature sensor.

14. The method of claim 8, wherein the temperature of said cookware object is measured via an infrared temperature sensor.

15. The method of claim 8, further comprising measuring the temperature of one of said stovetop or said hob.

16. The method of claim 15, further comprising controlling the power of said hob to regulate the temperature of one of said stovetop or said hob.

17. The method of claim 8, wherein if the temperature measured is lower than the temperature set by said temperature control interface, the power to the hob is either increased or maintained.

18. The method of claim 8, wherein if the temperature measured is higher than or equal to the temperature set by said temperature control interface, the power to the hob is decreased.

* * * * *